US011421175B2

(12) United States Patent
Iwasaki

(10) Patent No.: US 11,421,175 B2
(45) Date of Patent: Aug. 23, 2022

(54) GEAR OIL COMPOSITION FOR AUTOMOBILE, AND LUBRICATION METHOD

(71) Applicant: IDEMITSU KOSAN CO., LTD., Chiyoda-ku (JP)

(72) Inventor: Takeshi Iwasaki, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 16/634,283

(22) PCT Filed: Oct. 2, 2018

(86) PCT No.: PCT/JP2018/036765

§ 371 (c)(1),
(2) Date: Jan. 27, 2020

(87) PCT Pub. No.: WO2019/069878

PCT Pub. Date: Apr. 11, 2019

(65) Prior Publication Data

US 2020/0157457 A1 May 21, 2020

(30) Foreign Application Priority Data

Oct. 2, 2017 (JP) ..... JP2017-192827

(51) Int. Cl.

| | |
|---|---|
| ***C10M 141/10*** | (2006.01) |
| ***C10M 135/04*** | (2006.01) |
| ***C10M 137/02*** | (2006.01) |
| ***C10M 137/04*** | (2006.01) |
| *C10N 40/04* | (2006.01) |

(52) U.S. Cl.
CPC ..... *C10M 141/10* (2013.01); *C10M 135/04* (2013.01); *C10M 137/02* (2013.01); *C10M 137/04* (2013.01); *C10M 2223/04* (2013.01); *C10M 2223/049* (2013.01); *C10N 2040/04* (2013.01)

(58) Field of Classification Search
CPC ..... C10M 141/10; C10M 135/04; C10M 137/02; C10M 137/04; C10M 2223/04; C10M 2223/049; C10N 2040/04
See application file for complete search history.

(56) References Cited

U.S. PATENT DOCUMENTS

| | | | | |
|---|---|---|---|---|
| 5,358,650 | A * | 10/1994 | Srinivasan | C10M 133/56 508/194 |
| 9,080,125 | B2 * | 7/2015 | Deshimaru | C10M 141/10 |
| 2007/0027042 | A1 | 2/2007 | Suzuki et al. | |

FOREIGN PATENT DOCUMENTS

| | | | | |
|---|---|---|---|---|
| CA | 2151582 | A1 | 7/1994 | |
| CN | 101233218 | A | 7/2008 | |
| CN | 101280240 | A | 10/2008 | |
| CN | 102365354 | A | 2/2012 | |
| CN | 104560297 | A | 4/2015 | |
| CN | 105018190 | A | 11/2015 | |
| EP | 0391653 | A2 * | 10/1990 | C10M 137/08 |
| EP | 0 677 570 | | 10/1995 | |
| EP | 1 752 520 | | 2/2007 | |
| EP | 3 434 756 | | 1/2019 | |
| EP | 3 786 264 | | 3/2021 | |
| JP | 2-32195 | A | 2/1990 | |
| JP | 6-200274 | A | 7/1994 | |
| JP | 10-31 6987 | A | 12/1998 | |
| JP | 11-323371 | A | 11/1999 | |
| JP | 2007-39430 | A | 2/2007 | |
| JP | 2007-39480 | A | 2/2007 | |
| JP | 2009-520085 | A | 5/2009 | |
| WO | WO 94/14932 | A1 | 7/1994 | |
| WO | WO 2008/081287 | | 7/2008 | |
| WO | WO 2017/079017 | | 5/2017 | |
| WO | WO 2017/163977 | | 9/2017 | |

OTHER PUBLICATIONS

Thelubricantstore.com; Viscosity Grade Comparison Chart. Date unknown.*
International Search Report dated Jan. 15, 2019 in PCT/JP2018/036765 filed on Oct. 2, 2018, 2 pages.
Mori et al., "Low-viscosity Gear Oil Technology to Improve Wear at Tapered Roller Bearings in Differential Gear Unit," SAE International, vol. 9, Issue 3, Nov. 2016, DOI: 10.4271/2016-01-2204 (total 5 pages).
Office Action dated Aug. 17, 2021, in corresponding Japanese Patent Application No. 2017-192827 (with English-language Translation).
Supplementary European Search Report dated May 17, 2021, in corresponding European Patent Application EP 18 86 5025.
Combined Chinese Office Action and Search Report dated Nov. 8, 2021 in corresponding Chinese Patent Application No. 201880050563.8 (with English Translation of Category of Cited Documents), 13 pages.
Office Action dated May 31, 2022, in corresponding Chinese Patent Application No. 201880050563.8. with English translation.
Xu Binshi, "Surface Engineering", Jun. 30, 2022, China Machine Press, pp. 250-252.
Li Dianjia, "Equipment Lubrication Technology", Jan. 31, 2006, Ordnance Industry Press, pp. 205-207.

* cited by examiner

*Primary Examiner* — Cephia D Toomer
(74) *Attorney, Agent, or Firm* — Oblon, McClelland, Maier & Neustadt, L.L.P.

(57) ABSTRACT

Disclosed are a gear oil composition for automobiles containing at least (A) a base oil, (B) a sulfur-based extreme pressure agent, and (C) a phosphorus-based extreme pressure agent and satisfying specific requirements (i) and (ii), which is excellent in seizing resistance and wear resistance and also in fuel-saving performance, and a lubrication method using the gear oil composition.

7 Claims, No Drawings

GEAR OIL COMPOSITION FOR AUTOMOBILE, AND LUBRICATION METHOD

TECHNICAL FIELD

The present invention relates to a gear oil composition for automobiles, and a lubrication method using the gear oil composition.

BACKGROUND ART

A lubricating oil composition is used in various fields for internal combustion engines for use in gasoline engines, diesel engines and other internal combustion engines, and for gear systems (hereinafter also referred to as "gears"), etc., and a lubricating oil composition is required to have specific properties in accordance with use thereof. A lubricating oil composition for gears (hereinafter also referred to as "gear oil composition") is used, for example, for preventing damage and seizing of gears in use for gear systems (gears) having gears such as high-speed high-load gears for automobiles and others, relatively light-load gears for general machines, and relatively high-load gears for general machines, and is required to have properties of seizing resistance and wear resistance for preventing damage and seizing of gears. For use for differential gears among gears for automobiles, a gear oil composition is required to satisfy especially high-level seizing resistance and wear resistance since the load to be given to such gears is extremely high. In addition, in a differential gear, a bearing is built in, and it is important to prevent the bearing from being worn for securing durability of the gear.

Recently, in use for automobile gears, improved fuel-saving performance is also required in addition to the above-mentioned properties. By reducing the viscosity of a gear oil composition, the viscous resistance thereof can be reduced to improve fuel-saving performance, but on the other hand, in the case, oil film shortage may often occur to cause new problems of seizing and wear of gears and bearings. To that effect, properties such as seizing resistance and wear resistance that have heretofore been required for gear oil compositions and improvement of fuel-saving performance are conflicting properties, and since it is extremely difficult to satisfy both these properties, further technical development is desired (for example, see NPL 1).

As a lubricating oil capable of reducing a viscosity of a gear oil composition to reduce the viscosity resistance thereof and to improve the fuel-saving performance thereof, for example, there have been proposed a lubricant composition containing a lubrication viscosity oil, a dispersant and a phosphorus compound (see PTL 1), and a gear oil composition containing a predetermined hydrocarbon-based synthetic oil as a base oil and containing, as blended therein, an additive such as an extreme pressure agent (see PTL 2). However, these compositions are not investigated in point of severe seizing resistance and wear resistance that are required especially for use for differential gears, and it is difficult to say that these compositions could satisfy severer requirements recently required in the art.

CITATION LIST

Non-Patent Literature

NPL 1: Mori, T., Suemitsu, M., Umamori, N., Sato, T., Ogano, S., Ueno, K., Kuno, O., Hiraga, K., Yuasa, K., Shibata, S., Ishikawa, S., SAE International Journal of Fuels and Lubricants, November 2016, Vol. 9, No. 3

PATENT LITERATURE

PTL 1: JP 2009-520085 T
PTL 2: JP 2007-039430 A

SUMMARY OF INVENTION

Technical Problem

The present invention has been made in consideration of the above-mentioned situation, and its object is to provide a gear oil composition for automobiles excellent in seizing resistance and wear resistance and also excellent in fuel-saving performance, and to provide a lubrication method using the gear oil composition.

Solution to Problem

The present inventors have repeatedly made assiduous studies and have found that the above-mentioned problems can be solved by the following invention. Specifically, the present invention is to provide a gear oil composition for automobiles having the following constitution, and a lubrication method using the gear oil composition.

1. A gear oil composition for automobiles containing at least (A) a base oil, (B) a sulfur-based extreme pressure agent, and (C) a phosphorus-based extreme pressure agent and satisfying the following requirements (i) and (ii):

Requirement (i): $(a)\times(b)\times(c)$ is 0.08 or less, and

Requirement (ii): $[(a)\times(b)\times(c)/(d)]\times10000$ is 0.20 or less.

(In the requirements (i) and (ii):

(a) represents a wear track diameter (mm) of a fixed sphere after tested in a Shell four-ball wear test according to ASTM D4172-94(2010) and using 20-graded SUJ-2-made 0.5-inch balls at an oil temperature of 75° C. and a rotation number of 1500 rpm, under a load of 196 N and for a test time of 60 minutes;

(b) represents a wear track diameter (mm) of a fixed sphere after tested in a Shell four-ball wear test according to ASTM D4172-94(2010) and using 20-graded SUJ-2-made 0.5-inch balls at an oil temperature of 75° C. and a rotation number of 1500 rpm, under a load of 392 N and for a test time of 60 minutes;

(c) represents a wear width (mm) of a block after tested in a block-on-ring wear test according to ASTM D2714-94 (2003) and using H-60 as a block and S10 as a ring at an oil temperature of 120° C. and a rotation number of 1092 rpm, under a load of 100 N and for a test time of 20 minutes; and (d) represents a weld load (N) in a Shell four-ball load bearing (EP) test according to ASTM D2783-03(2014) using 20-graded SUJ-2-made 0.5-inch balls at room temperature and a rotation number of 1800 rpm.

2. A lubrication method using the gear oil composition for automobiles of the above 1.

Advantageous Effects of Invention

According to the present invention, there can be provided a gear oil composition for automobiles excellent in seizing resistance and wear resistance and also excellent in fuel-saving performance, and a lubrication method using the gear oil composition.

DESCRIPTION OF EMBODIMENTS

Embodiments of the present invention (hereinafter also referred to as "the present embodiment") are described below. In this description, numerical values of "X or more" and "Y or less" relating to the description of a numerical range are numerical values that can be combined in any manner.

[Gear Oil Composition for Automobiles]

The gear oil composition for automobiles of this embodiment contains at least (A) a base oil, (B) a sulfur-based extreme pressure agent, and (C) a phosphorus-based extreme pressure agent, and satisfies the following two requirements (i) and (ii) using measured values (a) to (d) in various wear tests and a load bearing test.

Requirement (i): (a)×(b)×(c) is 0.08 or less.

Requirement (ii): [(a)×(b)×(c)/(d)]×10000 is 0.20 or less.

<Requirement (i)>

The requirement (i) is such that, regarding (a) a wear track diameter (mm) of a fixed sphere after tested in a Shell four-ball wear test according to ASTM D4172-94(2010) and using 20-graded SUJ-2-made 0.5-inch balls at an oil temperature of 75° C. and a rotation number of 1500 rpm, under a load of 196 N and for a test time of 60 minutes, (b) a wear track diameter (mm) of a fixed sphere after tested in a Shell four-ball wear test according to ASTM D4172-94(2010) and using 20-graded SUJ-2-made 0.5-inch balls at an oil temperature of 75° C. and a rotation number of 1500 rpm, under a load of 392 N and for a test time of 60 minutes, and (c) a wear width (mm) of a block after tested in a block-on-ring wear test according to ASTM D2714-94(2003) and using H-60 as a block and S10 as a ring at an oil temperature of 120° C. and a rotation number of 1092 rpm, under a load of 100 N and for a test time of 20 minutes, the product of these (a)×(b)×(c) is 0.08 or less.

An automobile gear such as a differentia gear is formed of a gear unit and a bearing unit of a ball bearing or a tapered roller bearing, and has a contact part in a contact state under various contact pressure and sliding velocity conditions, and depending on the difference in the contact state, the above-mentioned different lubrication properties are required simultaneously. In this embodiment, by taking into account the above-mentioned (a), (b) and (c) that are indices of wear resistance under a contact pressure and in a sliding velocity region required for automobile gears, an automobile gear which has excellent wear resistance in a contact part thereof in various contact conditions can be provided.

In this embodiment, (a)×(b)×(c) in the requirement (i) needs to be 0.08 or less. If it is more than 0.08, the oil composition could not secure wear resistance. From the viewpoint of securing more excellent wear resistance, (a)×(b)×(c) is preferably 0.07 or less, more preferably 0.065 or less, even more preferably 0.06 or less. (a)×(b)×(c) is preferably smaller, but the lower limit thereof is generally 0.01 or more.

In the requirement (i), (a), (b) and (c) each are preferably selected from the following numerical range, while satisfying the requirements (i) and (ii).

(a) is, from the viewpoint of securing more excellent wear resistance, especially that considered for a sliding velocity and a contact pressure at a line (or dot) contact part such as a rolling face of a tapered roller bearing, preferably 0.40 or less, more preferably 0.39 or less even more preferably 0.38 or less, and the lower limit thereof is preferably smaller, but is generally 0.10 or more. (b) is, from the same viewpoint as above, preferably 0.55 or less, more preferably 0.50 or less, even more preferably 0.45 or less, and the lower limit thereof is preferably smaller, but is generally 0.10 or more. (c) is, from the viewpoint of securing more excellent wear resistance, especially that considered for a sliding velocity and a contact pressure at a face contact part such as an edge face of a tapered roller bearing, preferably 0.45 or less, more preferably 0.43 or less, even more preferably 0.40 or less, and the lower limit thereof is preferably smaller, but is generally 0.10 or more.

<Requirement (ii)>

The requirement (ii) is such that, in addition to (a), (b) and (c) in the requirement (i), when a weld load (N) in a Shell four-ball load bearing (EP) test according to ASTM D2783-03(2014) using 20-graded SUJ-2-made 0.5-inch balls at room temperature and a rotation number of 1800 rpm is represented by (d), [(a)×(b)×(c)/(d)]×10000 is 0.20 or less.

An automobile gear such as a differential gear is formed of a combination of various parts, and therefore has a contact part such as an engaging part of a gear such as a hypoid gear, in addition to the above-mentioned line (or dot) contact part such as a rolling face of a tapered roller bearing and a face contact part such as an edge face of a tapered rolling bearing. The contact part of such an engaging part of a gear is required to have seizing resistance in addition to wear resistance. In this embodiment, by taking into account the weld load (N) in a Shell four-ball load bearing (EP) test of the above (d) as an index of seizing resistance in a contact part such as an engaging part of a gear such as a hypoid gear, in addition to the index of wear resistance of the above-mentioned (a) to (c), in the requirement (ii), the gear oil composition which has excellent seizing resistance in a contact part such as an engaging part of a gear, along with excellent wear resistance in a line (or dot) contact part and a face contact part thereof can be provided.

In this embodiment, [(a)×(b)×(c)/(d)]×10000 of the requirement (ii) needs to be 0.20 or less. When it is more than 0.20, the oil composition could not secure seizing resistance and wear resistance. From the viewpoint of securing more excellent seizing resistance and wear resistance, [(a)×(b)×(c)/(d)]×10000 is preferably 0.197 or less, more preferably 0.195 or less. [(a)×(b)×(c)/(d)]×10000 is preferably smaller, but the lower limit thereof is generally 0.03 or more.

In the requirement (ii), (d) is preferably selected from the following numerical range while satisfying the requirements (i) and (ii) along with (a), (b) and (c).

(d) is, from the viewpoint of securing more excellent seizing resistance, especially that in a contact part such as an engaging part of a gear such as a hypoid gear, preferably 3089 or more, and the upper limit thereof is not specifically limited and is generally 3923 or less.

An automobile gear such as a differential gear is formed of a combination of various parts, and the contact state of those parts includes a line (or dot) contact part, a face contact part and further a gear engaging part; and an automobile gear oil composition is required to exhibit lubrication performance such as excellent seizing resistance and wear resistance in the contact parts in those various contact states. The automobile gear oil composition of this embodiment is so designed as to satisfy the requirements (i) and (ii) obtained by taking into account seizing resistance and wear resistance in the contact parts in such various contact states, and can therefore express excellent lubrication performance such as seizing resistance and wear resistance in the contact parts in various contact states. In this embodiment, the requirements (i) and (ii) can be controlled, for example, by suitably selecting and defining the kind and the amount of the base oil (A), the sulfur-based extreme pressure agent (B) and the phosphorus-based extreme pressure agent (C). The kind and the content of each component are as described below.

<(A) Base Oil>

The automobile gear oil composition of the present invention contains (A) a base oil. The base oil (A) may be a mineral oil or a synthetic oil.

The mineral oil includes a topped crude obtained through topping of a crude oil such as a paraffin-base, naphthene-base or intermediate-base crude oil; a distillate obtained through vacuum distillation of the topped crude; a mineral oil obtained through purification of the distillate in one or more treatments of solvent deasphalting, solvent extraction, hydrocracking, solvent dewaxing, catalytic dewaxing and hydro-refining, for example, a light neutral oil, a medium neutral oil, a heavy neutral oil or a bright stock, as well as a wax produced through Fischer-Tropsch synthesis (GTL wax).

The base oil may be any one grouped in Groups I, II and III in the base oil category by API (American Petroleum Institute), but from the viewpoint of more effectively retarding sludge formation and from the viewpoint of securing viscosity characteristics and securing stability against viscosity oxidative degradation, those grouped in Groups II and III are preferred.

Examples of the synthetic oil include poly-α-olefins such as polybutene, ethylene-α-olefin copolymers, α-olefin homopolymers or copolymers; various ester oils such as polyol esters, dibasic acid esters, and phosphates; various ethers such as polyphenyl ether; polyglycols, alkylbenzenes; and alkylnaphthalenes.

For the base oil (A), one alone or plural kinds of the above-mentioned mineral oils may be used either singly or as combined, or one alone or plural kinds of the above-mentioned synthetic oils may be used either singly or as combined. Also usable is a mixed oil of one or more mineral oils and one or more synthetic oils as combined.

The viscosity of the base oil (A) is not specifically limited, and 100° C. kinematic viscosity thereof is preferably 1 $mm^2/s$ or more, more preferably 3 $mm^2/s$ or more, even more preferably 5 $mm^2/s$ or more, and the upper limit thereof is preferably 20 $mm^2/s$ or less, more preferably 17 $mm^2/s$ or less, even more preferably 15 $mm^2/s$ or less. The 40° C. kinematic viscosity of the base oil (A) is preferably 5 $mm^2/s$ or more, more preferably 10 $mm^2/s$ or more, even more preferably 30 $mm^2/s$ or, and the upper limit thereof is preferably 120 $mm^2/s$ or less, more preferably 110 $mm^2/s$ or less, even more preferably 100 $mm^2/s$ or less. When the kinematic viscosity of the base oil (A) falls within the above range, fuel-saving performance, seizing resistance and wear resistance are bettered.

From the viewpoint of more bettering fuel-saving performance, seizing resistance and wear resistance, the viscosity index of the base oil (A) is preferably 90 or more, more preferably 100 or more, even more preferably 105 or more. In this description, the kinematic viscosity and the viscosity index are values measured using a glass capillary viscometer according to JIS K 2283:2000.

The content of the base oil (A) based on the total amount of the composition is generally 50% by mass or more, preferably 60% by mass or more, even more preferably 70% by mass or more, further more preferably 80% by mass or more. The upper limit thereof is preferably 97% by mas or less, more preferably 95% by mass or less, even more preferably 93% by mass or less.

<(B) Sulfur-Based Extreme Pressure Agent>

The automobile gear oil composition of this embodiment contains (B) a sulfur-based extreme pressure agent. Not containing a sulfur-based extreme pressure agent (B), the gear oil composition could not secure excellent seizing resistance and wear resistance.

Preferred examples of the sulfur-based extreme pressure agent (B) include sulfurized olefins, hydrocarbyl sulfides, sulfurized oils and fats, sulfurized fatty acids, and sulfurized esters. From the viewpoint of securing more excellent seizing resistance and wear resistance, and in consideration of corrosion, sulfurized olefins and hydrocarbyl sulfides are more preferred, and sulfurized olefins are even more preferred.

Sulfurized olefins are obtained by sulfurizing an olefin or a dimer to tetramer thereof, and from the viewpoint of securing more excellent seizing resistance and wear resistance, preferred are compounds that are produced through reaction of an olefin having 2 to 20 carbon atoms or a dimer to tetramer thereof and a sulfurizing agent such as sulfur or sulfur chloride; and more preferred are compounds represented by the following general formula (1).

$$R^{11}—S_{m_1}—R^{12} \quad (1)$$

In the general formula (1), $R^{11}$ represents an alkenyl group having 2 to 20 carbon atoms, $R^{12}$ represents an alkyl group or an alkenyl group having 1 to 20 carbon atoms, and $m_1$ represents an integer of 1 or more and 10 or less.

Regarding the carbon number of $R^{11}$ and $R^{12}$, from the viewpoint of securing more excellent seizing resistance and wear resistance, the lower limit thereof is preferably 3 or more, and the upper limit thereof is preferably 16 or less, more preferably 12 or less, even more preferably 8 or less, and especially preferably 4 or less. The alkyl group and the alkenyl group for $R^{11}$ and $R^{12}$ may be linear, branched or cyclic, and in consideration of easy availability, linear or branched groups are preferred.

Regarding $m_1$, from the viewpoint of securing more excellent seizing resistance and wear resistance, the upper limit thereof is preferably 8 or less, more preferably 6 or less, even more preferably 4 or less.

The sulfur content in the sulfurized olefin is, from the viewpoint of securing more excellent seizing resistance and wear resistance and in consideration of corrosion, preferably 20% by mass or more, more preferably 30% by mass or more, even more preferably 35% by mass or more, and especially more preferably 40% by mass or more, and the upper limit thereof is preferably 65% by mass or less, more preferably 60% by mass or less, even more preferably 55% by mass or less, and especially more preferably 50% by mass or less.

Preferred examples of the hydrocarbyl sulfide are, from the viewpoint of securing more excellent seizing resistance and wear resistance, compounds each having a structural unit shown by the following general formula (2).

$$\text{-}(R^{21}—S_{m_2})\text{-} \quad (2)$$

In the general formula (2), $R^2$ represents an alkylene group, an arylene group or an alkylarylene group, and $m_2$ represents an integer of 1 or more and 10 or less.

$R^{21}$ is, from the viewpoint of securing more excellent seizing resistance and wear resistance, and further in consideration of easy availability, preferably an alkylene group.

When $R^{21}$ is an alkylene group, the carbon number thereof is, from the viewpoint of securing more excellent seizing resistance and wear resistance, and further in consideration of easy availability, preferably 1 or more, more preferably 3 or more, even more preferably 6 or more, and the upper limit thereof is preferably 40 or less, more preferably 36 or less, even more preferably 30 or less. The alkylene group may be linear, branched or cyclic, but is preferably linear or branched.

When $R^{21}$ is an arylene group, the carbon number thereof is, from the viewpoint of securing more excellent seizing resistance and wear resistance, and further in consideration of easy availability, preferably 6 or more, and the upper limit thereof is preferably 20 or less, more preferably 16 or less, even more preferably 12 or less.

When $R^{21}$ is an alkylarylene group, the carbon number thereof is, from the viewpoint of securing more excellent seizing resistance and wear resistance, and further in consideration of easy availability, preferably 7 or more, and the upper limit thereof is preferably 20 or less, more preferably 16 or less, even more preferably 12 or less.

$m_2$ is an integer of 1 or more and 10 or less, and from the viewpoint of securing more excellent seizing resistance and wear resistance, and further in consideration of easy availability and corrosion, the upper limit thereof is preferably 8 or less, more preferably 6 or less, even more preferably 5 or less.

More specifically, examples of the compound having a structural unit represented by the above-mentioned general formula (2) as the hydrocarbyl sulfide include those represented by the following general formula (3).

$$R^{31}—S_{m_3}—(R^{21}—S_{m_2})_{p_3}R^{32} \quad (3)$$

In the general formula (3), $R^{21}$ and $m_2$ are the same as $R^{21}$ and $m_2$ in the general formula (2) mentioned above. $R^{31}$ represents a hydrogen atom or a monovalent organic group, $R^{32}$ represents a monovalent organic group, $m_3$ represents an integer of 10 or less, and $p_3$ represents an integer of 1 or more and 4 or less.

The monovalent organic group is preferably a monovalent organic group corresponding to the divalent organic group exemplified for $R^{21}$ (an alkylene group, an arylene group, an arylalkylene group) (an organic group formed by adding one hydrogen atom to the divalent organic group exemplified for $R^{21}$), that is, an alkyl group, an aryl group or an arylalkyl group.

$m_3$ is an integer of 10 or less, and from the viewpoint of securing more excellent seizing resistance and wear resistance and in consideration of easy availability and corrosion, the upper limit thereof is preferably 8 or less, more preferably 7 or less, even more preferably 6 or less, and the lower limit thereof is not specifically limited and may be 0.

$p_3$ is an integer of 1 or more and 4 or less, and from the viewpoint of securing more excellent seizing resistance and wear resistance and in consideration of easy availability and corrosion, it is preferably 3 or less, more preferably 2 or less.

Sulfurized oils and fats are those produced by reacting a sulfur or a sulfur-containing compound and any of oils and fats (e.g., lard oil, whale oil, vegetable oil, fish oil), and examples thereof include sulfurized lard, sulfurized rapeseed oil, sulfurized castor oil, sulfurized soybean oil, and sulfurized rice bran oil.

Sulfurized fatty acids include disulfurized fatty acids such as sulfurized oleic acid; and examples of sulfurized esters include esters of sulfurized fatty acids such as sulfurized methyl oleate, and sulfurized rice bran fatty acid octyl esters.

The sulfur content in the sulfur-based extreme pressure agent (B) except the sulfurized olefin is, from the viewpoint of securing more excellent seizing resistance and wear resistance and in consideration of corrosion, preferably 20% by mass or more, more preferably 30% by mass or more, even more preferably 35% by mass or more, especially more preferably 40% by mass or more, and the upper limit thereof is preferably 65% by mass or less, more preferably 60% by mass or less, even more preferably 55% by mass or less, especially more preferably 50% by mass or less, like that in the sulfurized olefin mentioned above.

The content of the sulfur-based extreme pressure agent (B), based on the total amount of the composition, is, from the viewpoint of securing more excellent seizing resistance and wear resistance and in consideration of corrosion, preferably 1% by mass or more, more preferably 2% by mass or more, even more preferably 3% by mass or more, especially more preferably 4% by mass or more, and the upper limit thereof is preferably 8% by mass or less, more preferably 7% by mass or less, even more preferably 6% by mass or less, especially more preferably 5.5% by mass or less.

Also from the same viewpoint, the content of the sulfur atom derived from the sulfur-based extreme pressure agent (B), based on the total amount of the composition, is, from the viewpoint of securing more excellent seizing resistance and wear resistance and in consideration of corrosion, preferably 1% by mass or more, more preferably 1.5% by mass or more, even more preferably 2% by mass or more, and the upper limit thereof is preferably 4% by mass or less, more preferably 3.5% by mass or less, even more preferably 3% by mass or less.

<(C) Phosphorus-Based Extreme Pressure Agent>

The automobile gear oil composition of this embodiment contains (C) a phosphorus-based extreme pressure agent. Not containing a phosphorus-based extreme pressure agent (C), the automobile gear oil composition could not secure excellent seizing resistance and wear resistance.

Preferred examples of the phosphorus-based extreme pressure agent (C) include phosphate compounds such as phosphates, acid phosphates, and phosphites, hydrogenphosphites, and amine salts of such phosphate compounds. More specifically, preferred examples of these phosphates, acid phosphates, phosphites and hydrogenphosphites include phosphates represented by the following general formula (4), acid phosphites represented by the following general formula (5), phosphites represented by the following general formula (6), and hydrogenphosphites represented by the following general formulae (7) and (8). In this embodiment, one alone or plural kinds of these compounds can be used as the phosphorus-based extreme agent (C), either singly or as combined.

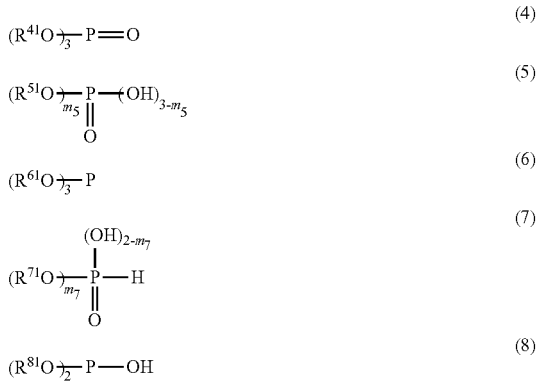

In the general formulae (4) to (8), $R^{41}$, $R^{51}$, $R^{61}$, $R^{71}$ and $R^{81}$ each independently represent a hydrocarbon group having 1 or more and 30 or less carbon atoms. The hydrocarbon group is, from the viewpoint of securing more excellent seizing resistance and wear resistance, preferably an alkyl group, an alkenyl group, an aryl group or an arylalkyl group, and further in consideration of easy availability, an alkyl group is more preferred.

In the case where $R^{41}$, $R^{51}$, $R^{61}$, $R^{71}$ and $R^{81}$ each are an alkyl group, the carbon number thereof is, from the viewpoint of securing more excellent seizing resistance and wear resistance and in consideration of easy availability, preferably 2 or more, more preferably 4 or more, even more preferably 10 or more, and the upper limit thereof is preferably 30 or less, more preferably 24 or less, even more preferably 20 or less. The alkyl group may be linear, branched or cyclic, but is preferably linear or branched, in consideration of easy availability.

In the case where $R^{41}$, $R^{51}$, $R^{61}$, $R^{71}$ and $R^{81}$ each are an alkenyl group, the carbon number thereof is, from the viewpoint of securing more excellent seizing resistance and wear resistance and in consideration of easy availability, preferably 2 or more, more preferably 4 or more, even more preferably 10 or more, and the upper limit thereof is preferably 30 or less, more preferably 24 or less, even more preferably 20 or less. The alkenyl group may be linear, branched or cyclic, but is preferably linear or branched.

In the case where $R^{41}$, $R^{51}$, $R^{61}$, $R^{71}$ and $R^{81}$ each are an aryl group, the carbon number thereof is, from the viewpoint of securing more excellent seizing resistance and wear resistance and in consideration of easy availability, preferably 6 or more, and the upper limit thereof is preferably 30 or less, more preferably 24 or less, even more preferably 20 or less. In the case where $R^{41}$, $R^{51}$, $R^{61}$, $R^{71}$ and $R^{81}$ each are an arylalkyl group, the carbon number thereof is, from the viewpoint of securing more excellent seizing resistance and wear resistance and in consideration of easy availability, preferably 7 or more, more preferably 10 or more, and the upper limit thereof is preferably 30 or less, more preferably 24 or less, even more preferably 20 or less.

Plural $R^{41}$'s, $R^{61}$'s and $R^{81}$'s each may be the same or different, and plural $R^{51}$'s and $R^{71}$'s, if any, each may also be the same or different.

In the general formula (5), $m_5$ represents 1 or 2, and in the general formula (7), $m_7$ represents 1 or 2.

Examples of the phosphates represented by the general formula (4) include triphenyl phosphate, tricresyl phosphate, benzyldiphenyl phosphate, ethyldiphenyl phosphate, tributyl phosphate, ethyldibutyl phosphate, cresyldiphenyl phosphate, dicresylphenyl phosphate, ethylphenyldiphenyl phosphate, diethylphenylphenyl phosphate, triethylphenyl phosphate, trihexyl phosphate, tri(2-ethylhexyl) phosphate, tridecyl phosphate, trilauryl phosphate, trimyristyl phosphate, tripalmityl phosphate, tristearyl phosphate, and trioleyl phosphate.

Examples of acid phosphates represented by the general formula (5) include mono(diethyl) acid phosphate, mono(di)-n-propyl acid phosphate, mono(di)-2-ethylhexyl acid phosphate, mono(di)-butyl acid phosphate, mono(di)oleyl acid phosphate, mono(di)isodecyl acid phosphate, mono(di)lauryl acid phosphate, mono(di)stearyl acid phosphate, and mono(di)isostearyl acid phosphate.

Examples of phosphites represented by the general formula (6) include triethyl phosphite, tributyl phosphite, triphenyl phosphite, tricresyl phosphite, tri(nonylphenyl) phosphite, tri(2-ethylhexyl) phosphite, tridecyl phosphite, trilauryl phosphite, triisooctyl phosphite, diphenylisodecyl phosphite, tristearyl phosphite, and trioleyl phosphite.

Examples of hydrogenphosphites represented by the general formulae (7) and (8) include mono(di)ethylhydrogen phosphite, mono(di)-n-propylhydrogen phosphite, mono(di)-n-butylhydrogen phosphite, mono(di)-2-ethylhexylhydrogen phosphite, mono(di)laurylhydrogen phosphite, mono(di)oleylhydrogen phosphite, mono(di)stearylhydrogen phosphite, and mono(di)phenylhydrogen phosphite.

Amine salts of phosphate compounds such as the above-mentioned phosphates, acid phosphates, phosphites and hydrogenphosphites are preferably amine salts formed from any of these phosphate compounds and an amine. Here, the amine for use for amine salt formation includes a primary amine, a secondary amine, a tertiary amine, and a polyalkyleneamine. The primary amine, the secondary amine and the tertiary amine includes amines represented by the following general formula (9).

$$R_{m_9}^{91}—NH_{3-m_9} \quad (9)$$

In the general formula (9), $R^{91}$ represents a hydrocarbon group having 1 or more and 30 or less carbon atoms, and specifically includes the same ones as those exemplified hereinabove for $R^{41}$, $R^{51}$, $R^{61}$, $R^{71}$ and $R^{81}$. In addition, $R^{91}$ further includes hydroxyalkyl groups in which a hydroxyl group substitutes for at least one hydrogen atom of alkyl groups exemplified hereinabove for $R^{41}$, $R^{51}$, $R^{61}$, $R^{71}$.

$m_9$ is 1, 2 or 3, and when $m_9$ is 1, the amine is a primary amine, when $m_9$ is 2, the amine is a secondary amine, and when $m_9$ is 3, the amine is a tertiary amine.

Examples of polyalkyleneamines include ethylenediamine, diethylenetriamine, triethylenetetr amine, tetraethylenep entamine, pentaethylenehexamine, hexaethyleneheptamine, heptaethyleneoctamine, tetrapropylenepentamine, and hexabutyleneheptamine.

Among these, from the viewpoint of securing more excellent seizing resistance and wear resistance, phosphates, acid phosphates, acid phosphate amine salts and hydrogenphosphites are preferred; acid phosphate amine salts and hydrogenphosphites are more preferred; and combined use of an acid phosphate amine salt and a hydrogenphosphite is even more preferred. Among hydrogenphosphites represented by the general formulae (7) and (8), those represented by the general formula (7) are preferred.

The phosphorus content in the phosphorus-based extreme pressure agent (C) is, from the viewpoint of securing more excellent seizing resistance and wear resistance, preferably 1% by mass or more, more preferably 3% by mass or more, even more preferably 4.5% by mass or more, and the upper limit thereof is preferably 10% by mass or less, more preferably 8% by mass or less, even more preferably 6% by mass or less.

The content of the phosphorus-based extreme pressure agent (C), based on the total amount of the composition, is, from the viewpoint of securing more excellent seizing resistance and wear resistance, preferably 0.5% by mass or more, more preferably 1% by mass or more, even more preferably 1.5% by mass or more, and the upper limit thereof is preferably 3% by mass or less, more preferably 2.5% by mass or less, even more preferably 2% by mass or less.

Also from the same viewpoint, the content of the phosphorus atom derived from the phosphorus-based extreme pressure agent (C), based on the total amount of the composition, is, from the viewpoint of securing more excellent seizing resistance and wear resistance, preferably 0.1% by mass or more, more preferably 0.3% by mass or more, even more preferably 0.5% by mass or more, and the upper limit thereof is preferably 3% by mass or less, more preferably 2.5% by mass or less, even more preferably 2% by mass or less.

In the case where an acid phosphate amine salt and a hydrogenphosphate are used as combined as the phosphorus-based extreme pressure agent (C), the blending ratio of the two is, from the viewpoint of securing more excellent seizing resistance and wear resistance, preferably 30/70 to 90/10, more preferably 40/60 to 80/20, even more preferably 45/55 to 75/25.

The phosphorus content in the acid phosphate amine salt is, from the viewpoint of securing more excellent seizing resistance and wear resistance, preferably 4.5% by mass or more, more preferably 4.8% by mass or more, even more preferably 5.0% by mass or more, and the upper limit thereof is preferably 9.0% by mass or less, more preferably 8.0% by mass or less, even more preferably 6.0% by mass or less.

The phosphorus content in the hydrogenphosphate is, from the viewpoint of securing more excellent seizing resistance and wear resistance, preferably 3.0% by mass or more, more preferably 4.0% by mass or more, even more preferably 4.5% by mass or more, and the upper limit thereof is preferably 6.5% by mass or less, more preferably 6.3% by mass or less, even more preferably 6.0% by mass or less.

In this embodiment, an extreme pressure agent containing both a sulfur atom and a phosphorus atom (hereinafter also referred to as "sulfur-phosphorus-based extreme pressure agent") can be used. The sulfur-phosphorus-based extreme pressure agent includes monothiophosphates, dithiophosphates, trithiophosphates, monothiophosphate amine bases, dithiophosphate amine salts, monothiophosphites, dithiophosphites, and trithiophosphites. One alone or plural kinds of these may be used either singly or as combined. Among these, from the viewpoint of securing more excellent seizing resistance and wear resistance, dialkyl dithiophosphates and diaryl dithiophosphates, for example, dithiophosphates such as dihexyl dithiophosphate, dioctyl dithiophosphate, di(octylthioethyl) dithiophosphate, dicyclohexyl dithiophosphate, dioleyl dithiophosphate, diphenyl dithiophosphate and dibenzyl dithiophosphates are preferred.

In the case of using a sulfur-phosphorus-based extreme pressure agent, the amount thereof to be used is the same as the amount of the phosphorus content derived from the phosphorus-based extreme pressure agent (C), or the content of the phosphorus-based extreme pressure agent (C), since the sulfur content in the sulfur-phosphorus-based extreme agent is generally small. Needless-to-say, the amount of the sulfur-phosphorus-based extreme pressure agent to be used is preferably so controlled that the total sulfur atom content and the total phosphorus atom content contained in the automobile gear oil composition, based on the total amount of the composition, each are to fall within the range mentioned below.

<Other Additives>

In the automobile gear oil composition of this embodiment, any other additives such as a dispersant, a viscosity index improver, a pour-point depressant, a friction modifier, an antioxidant, an anti-foaming agent, and a metal deactivator can be appropriately selected and blended in addition to the base oil (A), the sulfur-based extreme pressure agent (B) and the phosphorus-based extreme pressure agent (C), within a range not detracting from the object of the present invention. One alone or plural kinds of these additives may be used either singly or as combined.

The automobile gear oil composition of this embodiment may be composed of the base oil (A), the sulfur-based extreme pressure agent (B) and the phosphorus-based extreme pressure agent (C), or may be composed of these components along with any other additives. The total content of the other additives is not specifically limited within a range not detracting from the object of the present invention, but in consideration of the effect of adding the other additives, the amount thereof to be added is, based on the total amount of the composition, preferably 0.1% by mass or more, more preferably 0.5% by mass or more, even more preferably 1% by mass or more. The upper limit thereof is preferably 15% by mass or less, more preferably 13% by mass or less, even more preferably 10% by mass or less.

(Dispersant)

Examples of the dispersant include ash-free dispersants such as boron-free succinimides, boron-containing succinimides, benzylamines, boron-containing benzylamines, succinates, and mono or di-carboxylic acid amides typically such as fatty acids or succinic acid. Using a dispersant, the solubility of the sulfur-based extreme pressure agent (B) and the phosphorus-based extreme pressure agent (C) can increase to thereby readily secure more excellent seizing resistance and wear resistance.

(Viscosity Index Improver)

Examples of the viscosity index improver include polymers such as non-dispersant-type polymethacrylates, dispersant-type polymethacrylates, and styrene-based polymers (for example, styrene-diene copolymers, styrene-isoprene copolymers).

The number-average molecular weight (Mn) of the viscosity index improver may be appropriately defined depending on the kind thereof, but is, from the viewpoint of viscosity characteristics, preferably 500 or more and 1,000,000 or less, more preferably 5,000 or more and 800,000 or less, even more preferably 10,000 or more and 600,000 or less.

In the case of a non-dispersant-type or dispersant-type polymethacrylates, the number-average molecular weight thereof is preferably 5,000 or more and 300,000 or less, more preferably 10,000 or more and 150,000 or less, even more preferably 20,000 or more and 100,000 or less.

The content of the viscosity index improver is, from the viewpoint of viscosity characteristics, preferably 0.5% by mass or more based on the total amount of the composition, more preferably 1% by mass or more, even more preferably 3% by mass or more. The upper limit thereof is preferably 10% by mass or less, more preferably 9% by mass or less, even more preferably 8% by mass or less.

(Pour-Point Depressant)

Examples of the pour-point depressant include ethylene-vinyl acetate copolymers, condensates of chlorinated paraffin and naphthalene, condensates of chlorinated paraffin and phenol, polymethacrylates, and polyalkylstyrenes.

(Friction Modifier)

Examples of the friction modifier include ash-free friction modifiers such as aliphatic amines, aliphatic alcohols, fatty acid amines, fatty acid esters, fatty acid amides, fatty acids and fatty acid ethers having at least one alkyl or alkenyl group having 6 or more and 30 or less carbon atoms, especially at least one linear alkyl group or linear alkenyl group having 6 or more and 30 or less carbon atoms in the molecule; and molybdenum-based friction modifiers such as molybdenum dithiocarbamate (MoDTC), molybdenum dithiophosphate (MoDTP) and molybdic acid amine salts.

(Antioxidant)

Examples of the antioxidant include amine-based antioxidants such as diphenylamine-based antioxidants, and naphthylamine-based antioxidants; phenol-based antioxidants such as monophenol-based antioxidants, diphenol-based antioxidants, and hindered phenol-based antioxidants; molybdenum-based antioxidants such as molybdenum amine complexes produced by reacting molybdenum trioxide and/or molybdic acid and an amine compound; sulfur-based antioxidants such as phenothiazine, dioctadecyl sulfide, dilauryl-3,3'-thiodipropionate, and 2-mercaptobenzimidazole; and other phosphorus-based antioxidants.

(Anti-Foaming Agent)

Examples of the anti-foaming agent include silicone oil, fluorosilicone oil, and fluoroalkyl ether.

(Metal Deactivator)

The metal deactivator includes benzotriazole compounds, tolyltriazole compounds, thiadiazole compounds, and imidazole compounds.

(Various Physical Properties of Gear Oil Composition for Automobiles)

Regarding the viscosity of the automobile gear oil composition of this embodiment, the 100° C. kinematic viscosity thereof is preferably 5 $mm^2/s$ or more, more preferably 6 $mm^2/s$ or more, even more preferably 7 $mm^2/s$ or more. The upper limit thereof is preferably 13.5 $mm^2/s$ or less, more preferably 13 $mm^2/s$ or less, even more preferably 12.5 $mm^2/s$ or less.

The 40° C. kinematic viscosity of the automobile gear oil composition of this embodiment is preferably 10 $mm^2/s$ or more, more preferably 30 $mm^2/s$ or ore, even more preferably 50 $mm^2/s$ or more. The upper limit thereof is preferably 120 $mm^2/s$ or less, more preferably 110 $mm^2/s$ or less, even more preferably 100 $mm^2/s$ or less. When the kinematic viscosity of the automobile gear oil composition of this embodiment falls within the above-mentioned range, fuel-saving performance betters, and seizing resistance and wear resistance also better.

From the viewpoint of bettering fuel-saving performance, seizing resistance and wear resistance, the viscosity index of the automobile gear oil composition of this embodiment is preferably 90 or more, more preferably 100 or more, even more preferably 105 or more.

The total sulfur atom content contained in the automobile gear oil composition of this embodiment, based on the total amount of the composition is, from the viewpoint of securing more excellent seizing resistance and wear resistance and in consideration of corrosion, preferably 1% by mass or more, more preferably 1.5% by mass or more, even more preferably 2% by mass or more, and the upper limit thereof is preferably 3% by mass or less, more preferably 2.5% by mass or less, even more preferably 2.3% by mass or less.

The total phosphorus atom content contained in the automobile gear oil composition of this embodiment, based on the total amount of the composition is, from the viewpoint of securing more excellent seizing resistance and wear resistance, preferably 0.1% by mass or more, more preferably 0.3% by mass or more, even more preferably 0.5% by mass or more, and the upper limit thereof is preferably 3% by mass or less, more preferably 2% by mass or less, even more preferably 1.5% by mass or less.

(Production Method for Automobile Gear Oil Composition)

The automobile gear oil composition of this embodiment can be produced according to a production method that includes a step of mixing the above-mentioned base oil (A), sulfur-based extreme pressure agent (B) and phosphorus-based extreme pressure agent (C). In this production method, any other additives may be added in addition to the above-mentioned base oil (A), sulfur-based extreme pressure agent (B) and phosphorus-based extreme pressure agent (C).

In this production method, the blending amount of each of the above-mentioned base oil (A), sulfur-based extreme pressure agent (B) and phosphorus-based extreme pressure agent (C), and the other additives, and the other details thereof are the same as the above-mentioned content and the other detailed, and describing them is omitted here.

As described above, the automobile gear oil composition of this embodiment is excellent in seizing resistance and wear resistance and also in fuel-saving performance, and is therefore favorably used for lubrication of automobile gears, especially differential gears for gasoline vehicles, hybrid vehicles and electric vehicles. In addition, the automobile gear oil composition of this embodiment can also be favorably used, for example, for internal combustion engine oils for use for gasoline engines, diesel engines and other internal combustion engines, and also for hydraulic machines, turbines, compression machines, working machines, cutting machines, and machines equipped with gears, fluid bearings, and rolling bearings.

[Lubrication Method for Automobile Gears]

The lubrication method of this embodiment is a lubrication method for automobile gears using the automobile gear oil composition of the above-mentioned embodiment. The automobile gear oil composition for use in the lubrication method of this embodiment is excellent in seizing resistance and wear resistance and also in fuel-saving performance, and is therefore favorably used for lubrication of automobile gears, especially differential gears for gasoline vehicles, hybrid vehicles and electric vehicles.

EXAMPLES

Next, the present invention is described in more detail with reference to Examples, but the present invention is not whatsoever restricted by these Examples.

Examples 1 to 3, Comparative Examples 1 to 17

Gear oil compositions were prepared according to the blending amounts (% by mass) shown in Tables 1 to 3. The resultant gear oil compositions were tested in various tests according to the methods mentioned below to evaluate the physical properties thereof. The evaluation results are shown in Tables 1 to 3.

The properties of gear oil compositions were measured according to the methods mentioned below.

(1) Kinematic Viscosity

A kinematic viscosity at 40° C. and 100° C. was measured according to JIS K 2283:2000.

(2) Viscosity Index (VI)

Measured according to JIS K 2283:2000.

(3) Content of Sulfur Atom and Phosphorus Atom

Measured according to JIS-5S-38-92.

(4) Measurement of (a) and (b)

A wear track diameter (mm) of a fixed sphere, after tested in a Shell four-ball wear test according to ASTM D4172-94(2010) and using 20-graded SUJ-2-made 0.5-inch balls at an oil temperature of 75° C. and a rotation number of 1500 rpm, under a load of 196 N and for a test time of 60 minutes, was measured to be (a). In the same manner as that for the measurement of (a) but the load was changed from 196 N to 392 N, a wear track diameter (mm) of a fixed sphere after the test was measured to be (b).

(5) Measurement of (c)

A wear width (mm) of a block, after tested in a block-on-ring wear test according to ASTM D2714-94(2003) and using H-60 as a block and S10 as a ring at an oil temperature of 120° C. and a rotation number of 1092 rpm, under a load of 100 N and for a test time of 20 minutes, was measured to be (c).

(6) Measurement of (d)

A weld load (N) was measured in a Shell four-ball load bearing (EP) test according to ASTM D2783-03(2014) using 20-graded SUJ-2-made 0.5-inch balls at room temperature and a rotation number of 1800 rpm, and this is (d).

TABLE 1

| | | | | Example | | |
|---|---|---|---|---|---|---|
| | | | | 1 | 2 | 3 |
| Blending Amount | (A) | Mineral Oil | mass % | 88.8 | 88.9 | 89.4 |
| | (B) | S1 | mass % | 5.2 | 5.2 | — |
| | | S2 | mass % | — | — | 4.6 |
| | | S3 | mass % | — | — | — |
| | (C) | P1 | mass % | 1.4 | 0.9 | 1.4 |
| | | P2 | mass % | 0.5 | 0.9 | 0.5 |
| | | P3 | mass % | — | — | — |
| | | P4 | mass % | — | — | — |
| | | P5 | mass % | — | — | — |
| | | P6 | mass % | — | — | — |
| | | P7 | mass% | — | — | — |
| | | P8 | mass % | — | — | — |
| | | P9 | mass % | — | — | — |
| | | P10 | mass % | — | — | — |
| | | P11 | mass % | — | — | — |
| | | P12 | mass % | — | — | — |
| | | Other 1 | mass % | 4.1 | 4.1 | 4.1 |

TABLE 1-continued

| | | | Example | | |
|---|---|---|---|---|---|
| | | | 1 | 2 | 3 |
| | Other 2 | mass % | — | — | — |
| | Other 3 | mass % | — | — | — |
| | Other 4 | mass % | — | — | — |
| | Total | mass % | 100.0 | 100.0 | 100.0 |
| Properties of Gear Oil Composition | 40° Kinematic Viscosity | $mm^2/s$ | 96.1 | 95.0 | 97.7 |
| | 100° Kinematic Viscosity | $mm^2/s$ | 11.7 | 11.6 | 11.8 |
| | Viscosity Index | — | 111 | 111 | 110 |
| | Sulfur Content * 1 | mass % | 2.2 | 2.2 | 2.2 |
| | Phosphorus Content * 2 | mass % | 0.11 | 0.10 | 0.11 |
| | (a) | mm | 0.29 | 0.27 | 0.36 |
| | (b) | mm | 0.41 | 0.42 | 0.42 |
| | (c) | mm | 0.35 | 0.35 | 0.39 |
| | (d) | N | 3089 | 3089 | 3089 |
| | (a) × (b) × (c) | | 0.042 | 0.040 | 0.059 |
| | [(a) × (b) × (c)/(d)] * 10000 | | 0.135 | 0.128 | 0.191 |

TABLE 2

| | | | | Comparative Examples | | | | | | | |
|---|---|---|---|---|---|---|---|---|---|---|---|
| | | | | 1 | 2 | 3 | 4 | 5 | 6 | 7 | 8 |
| Blending Amount | (A) | Mineral Oil | mass % | 92.0 | 93.0 | 92.0 | 86.7 | 86.8 | 88.9 | 88.8 | 89.6 |
| | (B) | S1 | mass % | — | — | — | — | — | 5.2 | 5.2 | 5.2 |
| | | S2 | mass % | — | — | — | — | — | — | — | — |
| | | S3 | mass % | — | — | — | 7.3 | 7.3 | — | — | — |
| | (C) | P1 | mass % | — | — | — | 1.4 | 0.9 | 1.8 | — | — |
| | | P2 | mass % | — | — | — | 0.5 | 0.9 | — | 1.9 | — |
| | | P3 | mass % | — | — | — | — | — | — | — | 1.1 |
| | | P4 | mass % | — | — | — | — | — | — | — | — |
| | | P5 | mass % | — | — | — | — | — | — | — | — |
| | | P6 | mass % | — | — | — | — | — | — | — | — |
| | | P7 | mass % | — | — | — | — | — | — | — | — |
| | | P8 | mass % | — | — | — | — | — | — | — | — |
| | | P9 | mass % | — | — | — | — | — | — | — | — |
| | | P10 | mass % | — | — | — | — | — | — | — | — |
| | | P11 | mass % | — | — | — | — | — | — | — | — |
| | | P12 | mass % | — | — | — | — | — | — | — | — |
| | | Other 1 | mass % | — | — | — | 4.1 | 4.1 | 4.1 | 4.1 | 4.1 |
| | | Other 2 | mass % | 8.0 | — | — | — | — | — | — | — |
| | | Other 3 | mass % | — | 7.0 | — | — | — | — | — | — |
| | | Other 4 | mass % | — | — | 8.0 | — | — | — | — | — |
| | | Total | mass % | 100.0 | 100.0 | 100.0 | 100.0 | 100.0 | 100.0 | 100.0 | 100.0 |
| Properties of Gear Oil Composition | | 40° Kinematic Viscosity | $mm^2/s$ | 79.9 | 84.4 | 85.4 | 92.5 | 91.4 | 99.1 | 93.0 | 96.8 |
| | | 100° Kinematic Viscosity | $mm^2/s$ | 10.1 | 10.5 | 10.6 | 11.3 | 11.2 | 11.9 | 11.5 | 11.7 |
| | | Viscosity Index | — | 107 | 107 | 107 | 110 | 110 | 111 | 112 | 110 |
| | | Sulfur Content * 1 | mass % | 2.0 | 2.2 | 1.9 | 2.2 | 2.2 | 2.2 | 2.2 | 2.3 |
| | | Phosphorus Content * 2 | mass % | 0.11 | 0.12 | 0.11 | 0.11 | 0.10 | 0.10 | 0.10 | 0.10 |
| | | (a) | mm | 0.81 | 0.76 | 0.38 | 0.70 | 0.60 | 0.32 | 0.42 | 0.37 |
| | | (b) | mm | 0.93 | 0.35 | 0.50 | 0.39 | 0.41 | 0.39 | 0.54 | 0.50 |
| | | (c) | mm | 0.83 | 0.39 | 0.55 | 0.38 | 0.36 | 0.42 | 0.32 | 0.53 |
| | | (d) | N | 3923 | 3089 | 3089 | 2452 | 3089 | 2452 | 3089 | 3923 |
| | | (a) × (b) × (c) | | 0.625 | 0.104 | 0.105 | 0.104 | 0.089 | 0.052 | 0.073 | 0.098 |
| | | [(a) × (b) × (c)/(d)] * 10000 | | 1.594 | 0.336 | 0.338 | 0.423 | 0.287 | 0.214 | 0.235 | 0.250 |

TABLE 3

| | | | | Comparative Example | | | | | | | | |
|---|---|---|---|---|---|---|---|---|---|---|---|---|
| | | | | 9 | 10 | 11 | 12 | 13 | 14 | 15 | 16 | 17 |
| Blending Amount | (A) | Mineral Oil | mass % | 90.1 | 89.9 | 89.9 | 89.1 | 88.2 | 89.5 | 90.0 | 89.7 | 89.2 |
| | (B) | S1 | mass % | 5.2 | 5.2 | 5.2 | 5.2 | 5.2 | 5.2 | 5.2 | 5.2 | 5.2 |
| | | S2 | mass % | — | — | — | — | — | — | — | — | — |
| | | S3 | mass % | — | — | — | — | — | — | — | — | — |
| | (C) | P1 | mass % | — | — | — | — | — | — | — | — | — |
| | | P2 | mass % | — | — | — | — | — | — | — | — | — |
| | | P3 | mass % | — | — | — | — | — | — | — | — | — |
| | | P4 | mass % | 0.6 | — | — | — | — | — | — | — | — |
| | | P5 | mass % | — | 0.8 | — | — | — | — | — | — | — |
| | | P6 | mass % | — | — | 0.8 | — | — | — | — | — | — |
| | | P7 | mass % | — | — | — | 1.6 | — | — | — | — | — |
| | | P8 | mass % | — | — | — | — | 2.5 | — | — | — | — |
| | | P9 | mass % | — | — | — | — | — | 1.2 | — | — | — |
| | | P10 | mass % | — | — | — | — | — | — | 0.7 | — | — |
| | | P11 | mass % | — | — | — | — | — | — | — | 1.0 | — |
| | | P12 | mass % | — | — | — | — | — | — | — | — | 1.5 |
| | | Other 1 | mass % | 4.1 | 4.1 | 4.1 | 4.1 | 4.1 | 4.1 | 4.1 | 4.1 | 4.1 |
| | | Other 2 | mass % | — | — | — | — | — | — | — | — | — |
| | | Other 3 | mass % | — | — | — | — | — | — | — | — | — |
| | | Other 4 | mass % | — | — | — | — | — | — | — | — | — |
| | | Total | mass % | 100.0 | 100.0 | 100.0 | 100.0 | 100.0 | 100.0 | 100.0 | 100.0 | 100.0 |
| Properties of Gear Oil Composition | | 40° Kinematic Viscosity | $mm^2/s$ | 95.1 | 96.1 | 95.3 | 97.0 | 97.6 | 90.8 | 90.4 | 93.0 | 92.6 |
| | | 100° Kinematic Viscosity | $mm^2/s$ | 11.6 | 11.7 | 11.6 | 11.8 | 11.8 | 11.2 | 11.2 | 11.5 | 11.4 |
| | | Viscosity Index | — | 111 | 111 | 111 | 112 | 110 | 111 | 111 | 112 | 111 |
| | | Sulfur Content * 1 | mass % | 2.3 | 2.3 | 2.3 | 2.3 | 2.3 | 2.3 | 2.3 | 2.2 | 2.3 |
| | | Phosphorus Content * 2 | mass % | 0.10 | 0.10 | 0.10 | 0.10 | 0.10 | 0.10 | 0.10 | 0.10 | 0.10 |
| | | (a) | mm | 0.40 | 0.39 | 0.37 | 0.37 | 0.41 | 0.77 | 0.48 | 0.54 | 0.35 |
| | | (b) | mm | 0.71 | 0.63 | 0.61 | 0.62 | 0.50 | 0.94 | 0.58 | 0.56 | 0.69 |
| | | (c) | mm | 0.56 | 0.41 | 0.39 | 0.37 | 0.40 | 0.45 | 0.35 | 0.32 | 0.56 |
| | | (d) | N | 2452 | 3089 | 3089 | 3089 | 3089 | 3923 | 3089 | 3089 | 3089 |
| | | (a) × (b) × (c) | | 0.159 | 0.101 | 0.088 | 0.085 | 0.082 | 0.326 | 0.097 | 0.097 | 0.135 |
| | | [(a) × (b) × (c)/(d)] * 10000 | | 0.649 | 0.326 | 0.285 | 0.275 | 0.265 | 0.830 | 0.315 | 0.313 | 0.438 |

Notes) *1 and *2 in Tables 1 to 3 are as mentioned below.

*1: This is a content of all sulfur atoms based on the total amount of the composition.

*2: This is a content of all sulfur atoms based on the total amount of the composition.

Details of the components shown in Tables 1 to 3 used in these Examples are as follows.

(A) Base oil, mineral oil: mineral oil grouped in the API base oil category, Group II, 40° C. kinematic viscosity: 91 mm2/s, 100° C. kinematic viscosity: 11 mm2/s, viscosity index: 107

S1: sulfur-based extreme pressure agent (commercial product, sulfurized olefin, sulfur content: 42% by mass)

S2: sulfur-based extreme pressure agent (commercial product, sulfurized olefin, sulfur content: 48% by mass)

S3: sulfur-based extreme pressure agent (commercial product, sulfurized olefin, sulfur content: 30% by mass)

P1: phosphorus-based extreme pressure agent (commercial product, acid phosphate amine salt, phosphorus content: 5.6% by mass)

P2: phosphorus-based extreme pressure agent (commercial product, hydrogenphosphite ester, phosphorus content: 5.3% by mass)

P3: phosphorus-based extreme pressure agent (commercial product, acid phosphate amine salt, phosphorus content: 9.1% by mass)

P4: phosphorus-based extreme pressure agent (commercial product, acid phosphate, phosphorus content: 17% by mass)

P5: phosphorus-based extreme pressure agent (commercial product, acid phosphate, phosphorus content: 13% by mass)

P6: phosphorus-based extreme pressure agent (commercial product, acid phosphate, phosphorus content: 13% by mass)

P7: phosphorus-based extreme pressure agent (commercial product, acid phosphate, phosphorus content: 6.3% by mass)

P8: phosphorus-based extreme pressure agent (commercial product, acid phosphate amine salt, phosphorus content: 4.0% by mass)

P9: phosphorus-based extreme pressure agent (commercial product, acid phosphate, phosphorus content: 8.3% by mass)

P10: phosphorus-based extreme pressure agent (commercial product, hydrogenphosphite, phosphorus content: 14% by mass)

P11: phosphorus-based extreme pressure agent (commercial product, hydrogenphosphite, phosphorus content: 10% by mass)

P12: phosphorus-based extreme pressure agent (commercial product, hydrogenphosphite, phosphorus content: 6.7% by mass)

Other 1: dispersant (boron-containing polybutenylsuccinimide, nitrogen content: 1.5% by mass, boron content: 1.3% by mass)

Other 2: commercially-available package for gear oil (sulfur content: 25% by mass, phosphorus content: 1.4% by mass)

Other 3: commercially-available package for gear oil (sulfur content: 31% by mass, phosphorus content: 1.7% by mass)

Other 4: commercially-available package for gear oil (sulfur content: 24% by mass, phosphorus content: 1.4% by mass)

As shown by the results in Table 1, the automobile gear oil compositions of Examples 1 to 3 satisfy the requirements (i) and (ii), and have a 40° C. kinematic viscosity of 95.0 to 97.7 mm2/s, a 100° C. kinematic viscosity of 11.6 to 11.8 mm2/s, and a viscosity index of 110 to 111, and therefore have excellent seizing resistance and wear resistance and also excellent fuel-saving performance.

On the other hand, as shown by the results in Tables 2 and 3, the oil compositions of Comparative Examples 1 to 17 do not satisfy at least one of the requirements (i) and (ii) and therefore cannot be said to have excellent seizing resistance and wear resistance.

INDUSTRIAL APPLICABILITY

The gear oil composition for automobiles of this embodiment is excellent in seizing resistance and wear resistance and is also excellent in fuel-saving performance. Accordingly, the gear oil composition is favorably used as an automobile gear oil for gasoline vehicles, hybrid vehicles and electric vehicles, especially for lubrication for automobile differential gears. In addition, the gear oil composition for automobiles of this embodiment is also favorably used, for example, for internal combustion engine oils for use for gasoline engines, diesel engines and other internal combustion engines, and also for hydraulic machines, turbines, compression machines, working machines, cutting machines, and machines equipped with gears, fluid bearings, and rolling bearings.

The invention claimed is:

1. A gear oil composition, comprising:

(A) a base oil, (B) a sulfur-based extreme pressure agent comprising a sulfurized olefin having a sulfur content of 35% by mass or more and 50% by mass or less, and (C) a phosphorus-based extreme pressure agent comprising an acid phosphate amine salt having a phosphorous content of 4.5% by mass or more and 6.0% by mass or less and a hydrogen phosphite having a phosphorous content of 4.5% by mass or more and 6.0% by mass or less, wherein a 100° C. kinematic viscosity of the gear oil composition is 5 $mm^2/s$ or more and 12.5 $mm^2/s$ or less, the total content of the sulfur atom based on the total amount of the composition is 2% by mass or more and 2.3% by mass or less, the total content of the phosphorous atom based on the total amount of the composition is 0.10% by mass or more and 0.11% by mass or less a blending ratio of the acid phosphate amine salt and the hydrogen phosphite is from 30/70 to 90/10, and the composition satisfies requirements (i) and (ii):

(i): (a)×(b)×(c) is 0.08 or less, and (ii): [(a)×(b)×(c)/(d)]×10000 is 0.20 or less, wherein:

(a) represents a wear track diameter (min) of a fixed sphere after testing in a Shell four-ball wear test according to ASTM D4172-94(2010) and using 20-graded SUJ-2-made 0.5-inch balls at an oil temperature of 75° C. and a rotation number of 1500 rpm, under a load of 196 N and for a test time of 60 minutes;

(b) represents a wear track diameter (mm) of a fixed sphere after testing in a Shell four-ball wear test according to ASTM D4172-94(2010) and using 20-graded SUJ-2-made 0.5-inch balls at an oil temperature of 75° C. and a rotation number of 1500 rpm, under a load of 392 N and for a test time of 60 minutes;

(c) represents a wear width (mm) of a block after testing in a block-on-ring wear test according to ASTM D2714-94(2003) and using H-60 as a block and S10 as a ring at an oil temperature of 120° C. and a rotation number of 1092 rpm, under a load of 100 N and for a test time of 20 minutes; and (d) represents a weld load (N) in a Shell four-ball load bearing (EP) test according to ASTM D2783-03(2014) using 20-graded SUJ-2-made 0.5-inch balls at room temperature and a rotation number of 1800 rpm.

2. The gear oil composition of claim 1, wherein (a) is 0.40 or less, (b) is 0.55 or less and (c) is 0.45 or less.

3. The gear oil composition of claim 1, wherein (d) is 3089 or more.

4. The gear oil composition of claim 1, wherein (B) consists of the sulfurized olefin.

5. The gear oil composition of claim 1, which is suitable for a differential gear.

6. A method of lubricating an automobile gear, the method comprising contacting the automobile gear with the gear oil composition of claim 1.

7. The method of claim 6, wherein the automobile gear is a differential gear.

* * * * *